United States Patent [19]

Glaze

[11] 4,003,598

[45] Jan. 18, 1977

[54] CHAIR MOUNTED TRAY

[75] Inventor: Thurman A. Glaze, Tampa, Fla.

[73] Assignee: Grace M. Masiello, Largo, Fla. ; a part interest

[22] Filed: June 6, 1975

[21] Appl. No.: 584,280

[52] U.S. Cl. ..... 297/194; 297/161

[51] Int. Cl.[2] ..... A47C 7/62

[58] Field of Search ..... 297/194, 145, 185, 188, 297/161, 160, 162, 170, 171, 173, 174; 211/131; 108/140, 6, 31; 248/119 R, 307, 425, 429

[56] References Cited

UNITED STATES PATENTS

| | | | |
|---|---|---|---|
| 171,528 | 12/1875 | Musser | 297/162 |
| 258,354 | 5/1882 | Bell | 297/162 X |
| 1,324,503 | 12/1919 | Hirsch | 297/161 |
| 1,634,929 | 7/1927 | Blitz et al. | 297/161 |
| 2,328,135 | 8/1943 | Gack | 248/226 A |
| 2,611,492 | 9/1952 | Watts | 248/307 X |
| 2,797,973 | 7/1957 | Culpepper | 297/194 X |
| 2,891,679 | 6/1959 | Maupin | 108/140 X |
| 3,267,887 | 8/1966 | Boyd | 297/194 X |
| 3,445,143 | 5/1969 | Swenson | 248/429 X |
| 3,586,368 | 6/1971 | Guild | 297/161 X |

*Primary Examiner*—James T. McCall
*Attorney, Agent, or Firm*—Robert F. Ruemeli

[57] ABSTRACT

An assembly for mounting a tray on a chair may be an integral part of a chair arm or may be releasably attached to a chair, and includes a cooperating slide and track, one on the chair and the other on a tray. The tray may be swung about a vertical axis and moved lengthwise of the track from a position alongside a person seated in the chair to a position in front of the person seated in the chair.

9 Claims, 7 Drawing Figures

CHAIR MOUNTED TRAY

This invention relates to furniture and to an assembly for mounting a tray on a chair and, more particularly, to such an assembly which may in part be integral with the chair or may be releasably attached to the chair.

As used herein the term tray means a relatively horizontal support for articles and may be in the form of a typical tray with side walls, a flat writing surface, or may be provided with depressions or cutouts for holding particular articles, or may be in the form of any other type of support not inconsistent with the tenor of this invention. Also as used herein the term chair means any suitable type chair such as a folding lawn chair, a wheel chair, or a chaise lounge, or a bench to which the tray may be secured to the bench seat.

BACKGROUND OF THE INVENTION

Various forms of supports for mounting trays, or the like, on chairs are shown in prior patents. For example, in U.S. Pat. No. 3,166,354, a folding lawn chair in the form of a chaise lounge has a tray support clamped to an arm. The primary purpose of this patent is to level the tray. U.S. Pat. No. 2,503,543, shows an overstuffed chair having a pair of folding table top parts which may be swung in front of a person sitting in the chair to provide a continuous table top across the person's lap. In U.S. Pat. No. 2,710,051, a writing surface is clamped to the seat of a chair and may be adjusted up and down and to a limited extent may be moved to and fro across the front of the person as well as pivoted in a horizontal plane. However, when clamped to the chair this support does not permit free movement of the writing surface from front to rear along the side of the person. U.S. Pat. No. 1,284,596, shows a chair having a pair of mirrors mounted on slides pivoted to opposite arms of the chair and permitting movement of the mirrors toward and away from a person sitting in the chair as well as pivotal movement of the mirrors about a vertical axis. In U.S. Pat. No. 158,844, an ironing board has a slide received in a track mounted on a table so that the ironing board may be moved longitudinally of the table as well as swung about a generally vertical axis.

BRIEF DESCRIPTION OF THE INVENTION

The invention, in brief, is directed to a tray supported on a chair and, preferably, on a lawn chair arm. A cooperating slide and track is provided, one on the chair and the other on the tray. The portion on the chair arm may be an integral part thereof or may be releasably secured thereto, and the portion on the tray is preferably releasably supported by the portion on the arm.

It is a primary object of this invention to provide a new and useful assembly for mounting of a tray on a chair. A related object is provision for mounting the tray on a chair arm. Another related object is provision of both sliding and pivotal movement of the tray relative to the chair. Still another related object is provision for releasably mounting on the chair an attachment including the slide and the track or, alternatively, for forming either the slide or the track as an integral part of the chair.

A more specific object is provision of a new and useful assembly for mounting a tray alongside a chair, the assembly mounting the tray for generally horizontal sliding movement to and fro along a side of the chair and for generally horizontal swinging movement between positions generally alongside the chair and generally in front of the chair. A related object is provision of cooperating parts including a track and a slide releasably interlocked for relative rotation, and for relative sliding movement in the direction of the track, with provision for securing one of the parts to the chair and the other of the parts to the tray. Another related object is provision of a track body with a groove having an inner face and a pair of flanges spaced apart to define a gap therebetween, the flanges being spaced outwardly from the inner face of the groove, and the slide having a first generally cylindrical portion extending through the gap and a second generally cylindrical portion larger than the first portion and said gap and received in the groove. Still another related object is provision of a stop at one end portion of the track for preventing removal of the slide therefrom, and provision at an opposite end portion of the track for insertion and removal of the slide from the track.

These and other objects and advantages of the invention will be apparent from the following description and the accompanying drawing.

DESCRIPTION OF THE ILLUSTRATED EMBODIMENT

Figure 1:
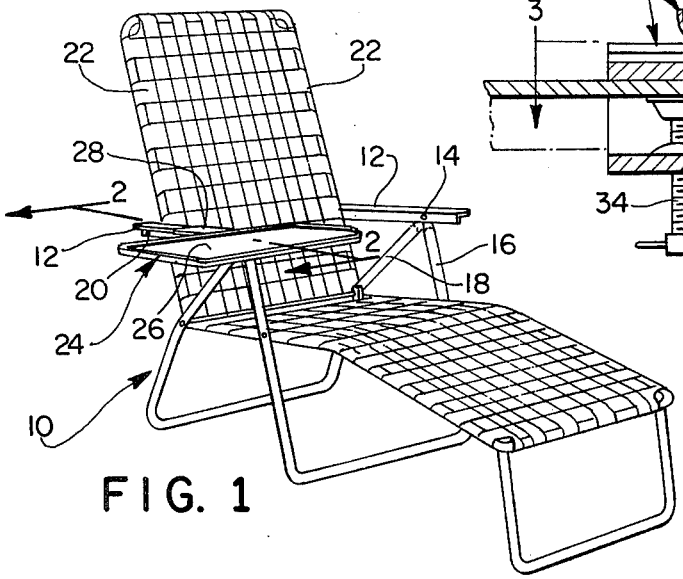
FIG. 1 is a perspective view of a lawn chair in the form of a chaise lounge, with a preferred embodiment of a tray attachment releasably secured to an arm of the chair.

Referring first to FIG. 1 of the drawing, a typical folding lawn chair 10, illustrated in the form of a chaise lounge, has a pair of opposite side arms 12, each arm pivoted at its front end by a pin 14, to an associated pair of side legs 16 and 18, and at its rear end pivoted by a pin 20 to an adjacent back side member 22 of the chair. A tray carrier 24 includes a tray 26, and a support 28 releasably secured to one of the arms 12 of the chair, as may best be seen in FIG. 2.

Figure 2:
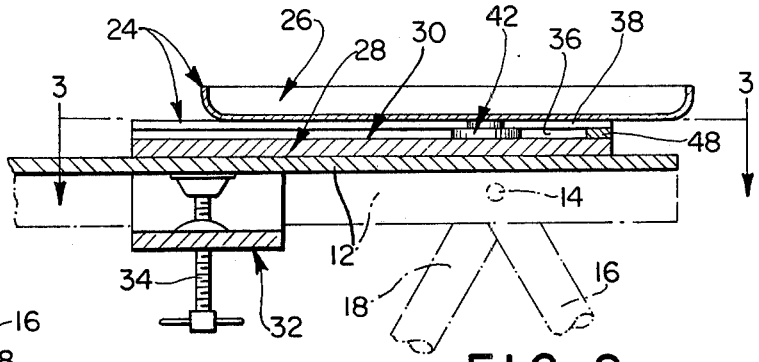
FIG. 2 is a fragmentary, sectional, elevational view taken generally along the line 2—2 in FIG. 1, with parts of the chair shown in phantom lines.
Figure 3:
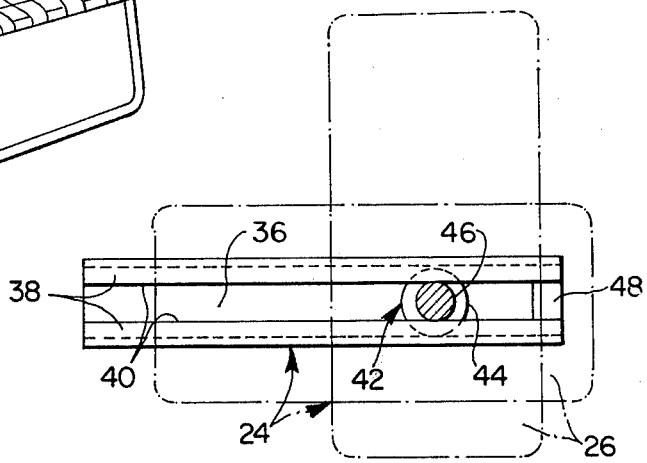
FIG. 3 is a sectional, plan view taken generally along the line 3—3 in FIG. 2, but with the attachment removed from the chair and with two positions of the tray shown in phantom lines, for clearer illustration.

With reference to FIGS. 2 and 3, the support 28 is in the form of a track 30 secured to a depending C-type clamp 32 having the usual threaded shank 34 for clamping the track 30 to a horizontal flange of an L-shaped arm 12. Track 30 is formed with a longitudinally extending groove 36 defined by a pair of opposed flanges 38 coextensive with and spaced above an inner face and herein the bottom face of the groove 36, the flanges being spaced apart to provide a longitudinally extending gap 40 for receiving a slide 42 integral with or suitably secured to the bottom face of the tray 26. A larger, lower cylindrical portion 44 of the slide 42 is received in the track groove 36 and is retained therein by the flanges 38, with a smaller upper portion 46 of the slide extending through the gap 40 and secured to the bottom of the tray.

The track 30 extends lengthwise of the arm 12 and has a stop 48 at either its front or rear end, and as illustrated the front end, to prevent removal of the slide 42 and the tray 26 from that end, while permitting insertion and removal of the slide and tray from the opposite end, the rear end.

Figure 4:
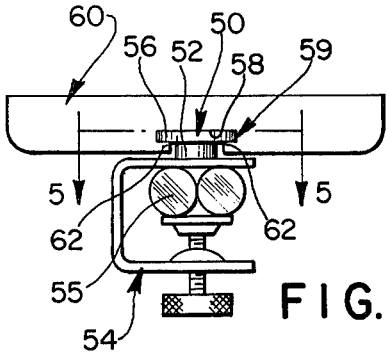
FIG. 4 illustrates another embodiment of the attachment releasably secured to the chair.
Figure 5:
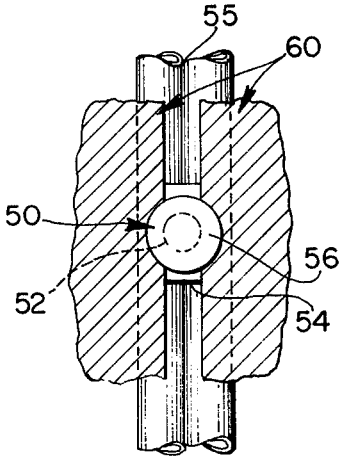
FIG. 5 is a fragmentary, sectional plan view taken generally along the line 5—5 in FIG. 4.

With reference to the embodiment shown in FIGS. 4 and 5, a slide 50 is substantially the same as the slide 42 shown in FIGS. 2 and 3, but inverted. Slide 50 has a suitable C-type clamp 54 releasably secured to a dual tube chair arm 55, mounted generally as previously described, with an upper, larger cylindrical portion 56 of the slide 50 received in a groove 58 of a track formed in the bottom of a tray 60, and with opposed horizontal flanges 62 underlying the larger cylindrical portion 56 and the smaller cylindrical portion 52 extending through a gap, as previously described with reference to the gap 40 in FIG. 3. A stop (not shown), as stop 48 in FIG. 2, is preferably provided to prevent removal of that end of the tray from the slide.

If desired, in both embodiments, any suitable stop (not shown) may be provided at the open end of the track 30 or 59 for retaining the tray in operative assembly, and these stops may each be in the form of a pin in a socket in the open end of the track 28, or extending through a hole in the bottom of the tray 60, if desired.

Figure 6:
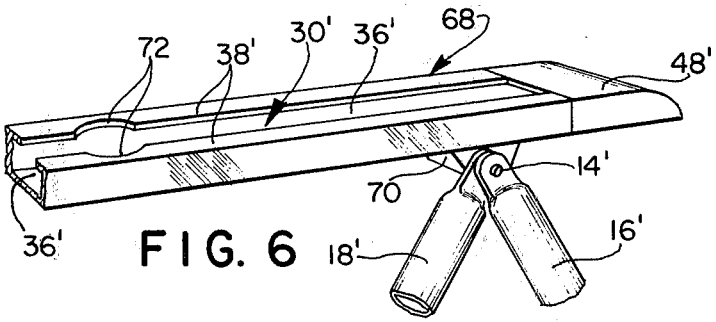
FIG. 6 is a fragmentary, perspective view of another embodiment of the invention, similar to the embodiment shown in FIGS. 1–3, but with a track thereof also forming a chair arm.

With reference to the embodiment shown in FIG. 6, reference numerals primed, as 16', refer to similar or identical parts as those described with reference to the embodiment of FIGS. 1–3, and these parts will not necessarily be described again. In FIG. 3, a pair of lawn chair legs 16' and 18' are secured by a pivot pin 14' to a lawn chair arm 68, and more particularly are secured to a boss 70 depending from the underside of the arm 68. The arm 68 has an integral track 30' for receiving the slide 42 (not shown in FIG. 6) which may be inserted and removed through an opening 72 in flanges 38' near the rear of the arm 68. A stop 48' is preferably contoured in any suitable manner to enhance the appearance of the arm and is shown as an integral part of the arm, to prevent removal of the tray and the slide 42 from the front end of the arm.

Figure 7:
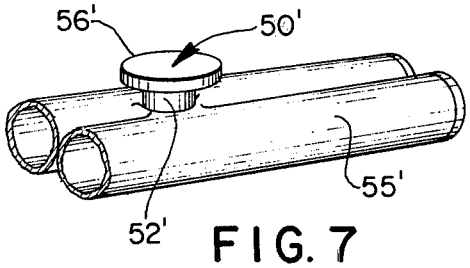
FIG. 7 is a fragmentary, perspective view of a further embodiment of the invention, similar to the embodiment of FIGS. 4 and 5, but with a slide thereof integrally with a chair arm.

In the embodiment shown in FIG. 7, reference numerals primed, as 55' refer to similar or identical parts as those described with reference to the embodiment of FIGS. 4 and 5, and these parts will not necessarily be again described. As shown in FIG. 7, the chair arm 55' has secured to its upper surface a slide 50' having a lower, smaller cylindrical portion 52' for extending through the gap between opposite faces of the flanges 62' of the tray track (FIGS. 4 and 5), and an upper, larger cylindrical portion 56' received in the groove 58 and retained therein by the flanges 62 of the tray track (FIGS. 4 and 5).

In any of the embodiments of this invention, a tray or other similar support may be moved forwardly and rearwardly along the side of a person sitting in the chair, and may also be swung in front of the person. In the embodiments of FIGS. 1–3 and 6, the slide 42 is preferably offset toward one end of the tray (see FIG. 3) in order to permit the tray to be swung in front of the person seated in the chair.

While this invention has been described with reference to particular embodiments in a particular environment, various changes may be apparent to one skilled in the art and the invention is therefore not to be limited to such embodiments or environments, except as set forth in the appended claims.

What is claimed is:

1. An assembly for mounting a tray alongside a chair, or the like, comprising means for mounting the tray for free generally horizontal sliding movement to and fro along a side of the chair and for generally horizontal swinging movement between positions generally alongside the chair and generally in front of the chair, and said means comprising cooperating parts including a track and a slide releasably interlocked for relative rotation and for relative sliding movement in the direction of the track, said track including a body having a groove defined by an inner face and a pair of opposed flanges spaced apart to define a gap therebetween, said pair of flanges being spaced outwardly from said inner face, said slide including a first generally cylindrical portion extending through said gap, and a second generally cylindrical portion larger than said first portion and said gap and received in said groove, when the slide and track are operatively assembled, and opposite faces of said second portion of said slide being in engagement with adjacent ones of said inner face and said flanges of said groove and cooperatively sized for retaining said tray substantially horizontally disposed during such generally horizontal sliding and swinging movement of the tray, means for operatively connecting one of said parts to the chair, and means for operatively connecting the other of said parts to the tray.

2. An assembly as set forth in claim 1 in which one of the attaching means releasably attaches the associated one of said parts to the chair.

3. An assembly as set forth in claim 2, in which the last said attaching means releasably clamps the associated part to an arm of the chair.

4. An assembly as set forth in claim 3 in which the part is said track.

5. An assembly as set forth in claim 3 in which the part is said slide.

6. An assembly as set forth in claim 1 in which one of the attaching means fixedly secures the associated one of said parts to the chair.

7. An assembly as set forth in claim 6 in combination with a chair, and in which the last said one of said parts is said track and said track is an arm of the chair.

8. An assembly as set forth in claim 6 in combination with a chair, and in which the last said one of said parts is said slide and is an integral part of an arm of the chair.

9. An assembly as set forth in claim 1 in which said track has a stop at one end portion preventing removal of the slide from said end portion, and provision at an opposite end portion for insertion and removal of the slide from the track.

* * * * *